United States Patent [19]

Greive

[11] 3,938,309

[45] Feb. 17, 1976

[54] SPINNING APPARATUS FOR GLASS-FIBER YARN

[75] Inventor: Aloys Greive, Munster, Germany

[73] Assignee: Hamel G.m.b.H., Zwirnmaschinen, Munster, Germany

[22] Filed: May 29, 1973

[21] Appl. No.: 364,552

[30] Foreign Application Priority Data

May 30, 1972 Germany ..... 2226284

[52] U.S. Cl. ..... 57/58.86; 57/58.49; 57/58.7; 57/58.83; 57/88

[51] Int. Cl.[2] ..... D01H 7/86; D01H 7/22

[58] Field of Search ..... 57/58.7, 58.72, 58.74, 57/58.83, 58.84, 58.86, 58.49, 88, 89

[56] References Cited

UNITED STATES PATENTS

| | | | |
|---|---|---|---|
| 1,826,354 | 10/1931 | Lenk | 57/58.86 X |
| 2,127,921 | 8/1938 | Kent | 57/58.74 |
| 2,609,652 | 9/1952 | DeHalleux | 57/58.83 |
| 3,145,524 | 8/1964 | Dewelle | 57/58.49 |
| 3,256,684 | 6/1966 | Stahlecker et al. | 57/88 |
| 3,299,623 | 1/1967 | Keyser | 57/58.84 |
| 3,314,227 | 4/1967 | Pfenningsberg | 57/88 |
| 3,382,661 | 5/1968 | Davies | 57/88 X |
| 3,466,864 | 9/1969 | Smith | 57/58.83 X |
| 3,557,541 | 1/1971 | Aucagne et al. | 57/58.86 |
| 3,742,693 | 7/1973 | Grieve et al. | 57/58.86 |
| 3,791,119 | 2/1974 | Godderidge | 57/58.86 X |

*Primary Examiner*—John Petrakes
*Attorney, Agent, or Firm*—Karl F. Ross; Herbert Dubno

[57] ABSTRACT

A spinning apparatus has a flyer which is rotated about its axis by a belt drive at one axial end of a spindle carrying the flyer. Received within the flyer and rotatable relative thereto is a yarn-package holder comprising a plush-lined cup snugly receiving a coreless package of glass-fiber yarn, and a takeup tube whose mouth lies within the package. A thread brake is provided within the takeup tube and the yarn holder is prevented from rotating with the flyer. The yarn of one or more threads is drawn off the inside of the package into the mouth of the nonrotating takeup tube, thence enters the end of the rotating spindle, passes radially out through the flyer under the yarn-package holder, and thence axially out through the rotating sleeve of the flyer. The tube of the flyer is formed by a pair of nested tubes connected by a corrugated stiffening element.

21 Claims, 10 Drawing Figures

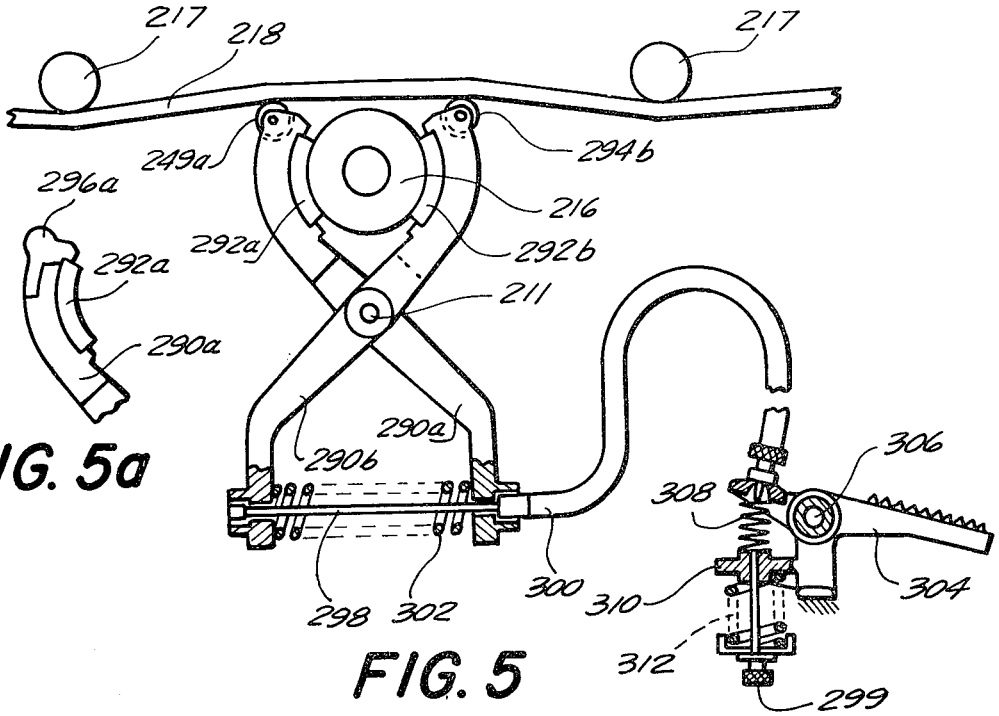
FIG. 5a
FIG. 5
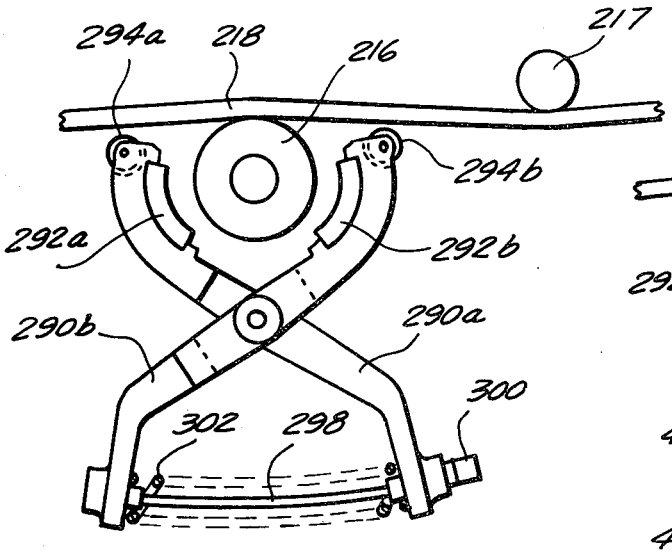
FIG. 6
FIG. 7
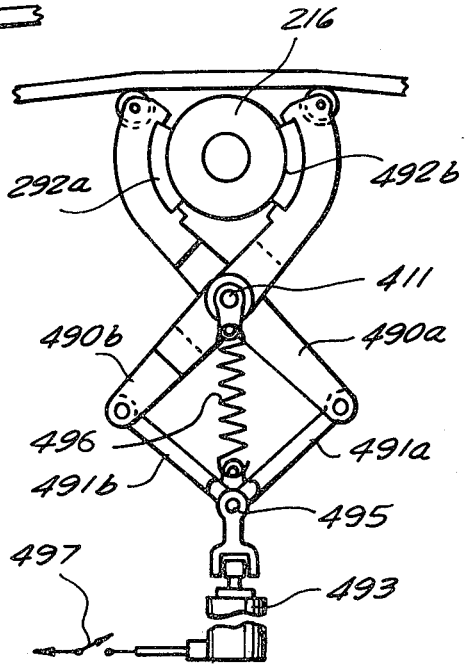

SPINNING APPARATUS FOR GLASS-FIBER YARN

FIELD OF THE INVENTION

The present invention relates to a spinning apparatus more particularly, to a spinning apparatus for with glass-fiber yarns.

CROSS REFERENCE TO RELATED APPLICATIONS

This application is related to copending app. Ser. No. 349,990 filed on Apr. 11, 1973 by Aloys Greive and Theodor Tiemann for a spinning apparatus.

BACKGROUND OF THE INVENTION

Spinning apparatus is known having a spindle which is rotated at high speed and which carries a flyer. Mounted within the flyer and rotatable relative thereto is a yarn-package holder in which a yarn package is carried. The yarn is drawn off the package, passes axially back through the spindle and radially out through the flyer, then forms a balloon around the yarn package holder. The yarn is then drawn axially away from the device, thereby being twisted to a degree dependent upon the pulloff speed and the rotation speed of the spindle.

Such devices have proven themselves highly useful with relatively durable filaments such as cotton or synthetic-resin yarn. However in the twisting of more fragile filaments, such as fiberglass yarns, these devices are almost totally unusable. This is due to the very low tensile strength of such yarns in their unspun condition. For this reason it has heretofore been found necessary to use traveler-ring spinning frames for glass fiber yarns.

OBJECTS OF THE INVENTION

It is therefore an object of the present invention to provide an improved spinning apparatus.

Another object is to provide such an apparatus which is particularly well suited for use with weak yarns, such as glass fiber yarns.

SUMMARY OF THE INVENTION

These objects are obtained according to the present invention in an apparatus wherein a coreless yarn package is received snugly within an axially open cup and is drawn off from the inside of the yarn package into a tube carried on the yarn holder and having a mouth which lies within the package. In this manner the yarn passes through a very short distance from the inside of the package to the mouth of the pickup tube, which tube houses the conventional threadbrake. In other respects this apparatus has a spindle which defines an axis about which the flyer is rotatable. This flyer comprises a base attached to the spindle and a sleeve extending axially from the base, the spindle and the flyer together being formed with a passage which opens axially at one end away from the base at the axis and at the other end at a location spaced from the axis on the sleeve.

The mouth of the takeup tube of the yarn-package holder lies within the yarn package at an axial distance from the end thereof toward the flyer base equal to between 20 and 80% of the axial height of the package, preferably between 30 and 50%. Thus this mouth lies generally in the middle of the package.

According to another feature of this invention, means is provided for preventing the yarn holder from rotating about the axis. This means can be an off-center weight provided in the yarn holder, when the axis of the spindle extends generally horizontally, or it can be a magnetic arrangement as is well known in the art.

In accordance with yet another feature of the present invention the horizontally oriented yarn holder is cylindrical and is lined internally with a pile fabric or plush whose pile extends towards the base of the cup so that the yarn package can be easily slipped thereinto but will not tend to slide out of this cup.

According to a further feature of this invention a cover is provided which sits snugly upon the tube of the flyer and which has an axially centered neck mounted in a bearing carried on a pivotal arm secured to the fixed housing of the apparatus. Thus the flyer is supported at both ends to prevent an excessive moment from being applied to the advantageously elastically-seated bearings journaling the flyer in the fixed frame carrying the whole apparatus. Such a cover further eliminates the chances of filament breakage by completely enclosing the spinner.

In accordance with a further feature of this invention the housing for the spinner is provided with heaters so as to dry the glass-fiber yarn as it is being twisted. This is advantageous since in the production of glass-fiber yarn a liquid is used to cool and lubricate the filaments as they are extruded from the spinneret.

According to another feature of this invention a whorl brake is provided to arrest the spinner. This brake comprises a pair of crossing commonly pivoted scissor arms each carrying at one end a brake pad engageable with the whorl and a roller and bumper which pushes the tape out of contact with the whorl. The other end of the arms are connected together with a foot-operated bowden arrangement so that the operator need merely step on a pedal to brake the spinner and push the drive belt away from the whorl. Alternatively it is possible to provide a solenoid to operate such a whorl brake.

DESCRIPTION OF THE DRAWING

The above and other objects, features, and advantages of the present invention will become more readily apparent from the following description, reference being made to the accompanying drawing in which:

FIG. 5 is an end view of a whorl brake according to the present invention;

FIG. 5*a* is a detail view showing another embodiment of the brake of FIG. 5;

FIG. 6 is a view similar to FIG. 5 of the brake thereof shown in the open or ineffective position;

FIG. 7 is a view similar to FIG. 5 showing an alternative whorl brake.

SPECIFIC DESCRIPTION

Figure 1:
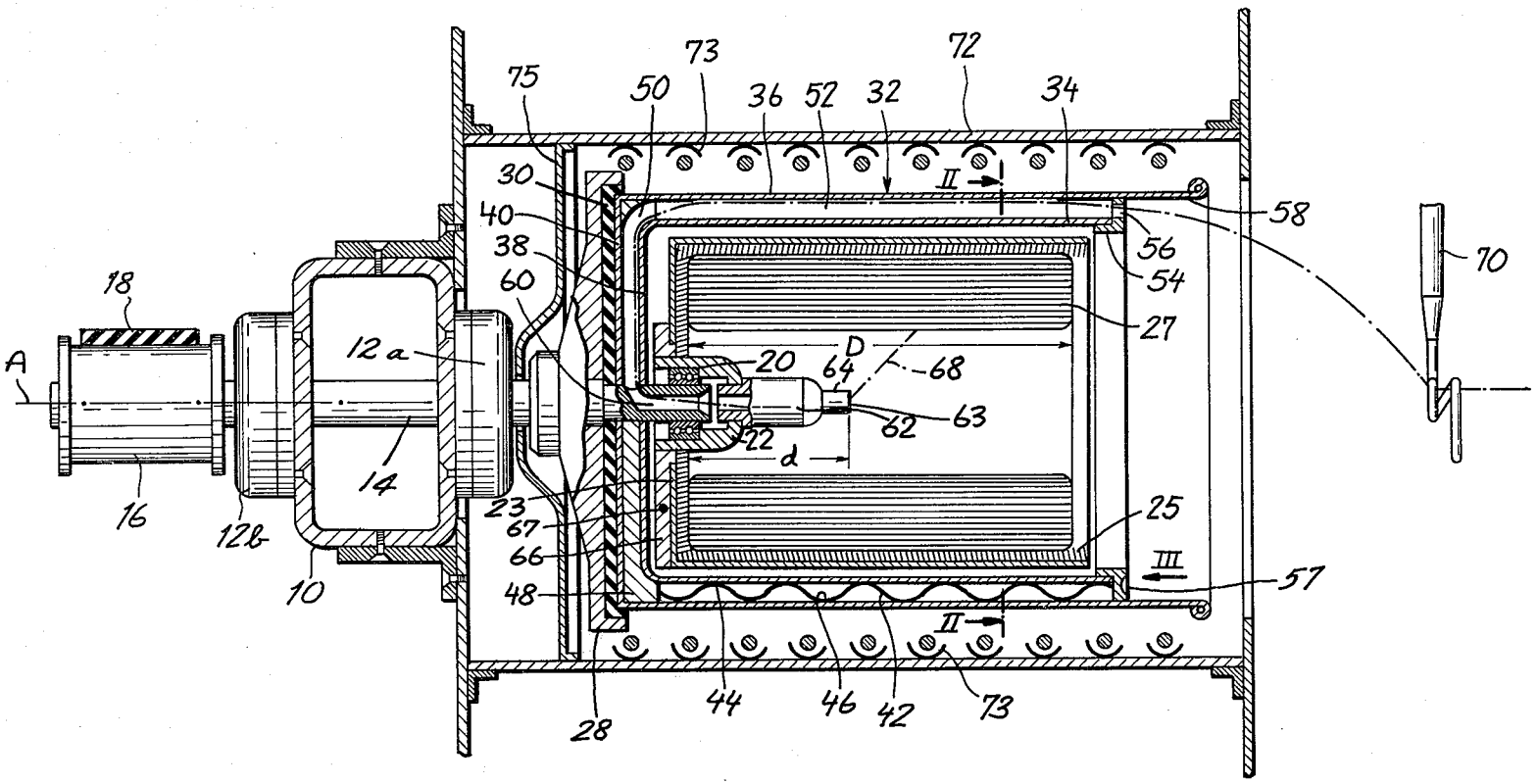
FIG. 1 is an axial section through an embodiment of the spinning apparatus according to the present invention.

As shown in FIG. 1 a spinning apparatus is mounted on a rectangular-section beam 10 and has a pair of main bearings 12*a* and 12*b* supporting a horizontal spindle 14 provided on one end with a whorl 16 adapted to be engaged tangentially by a flat belt 18 so as to rotate it about its horizontal axis A at a rate of at least 10,000 revolutions per minute. A ball bearing 20 on the spindle 14 carries a support hub 22. A cylindrical coreless yarn package 27 of a loose two-ply glass yarn 68 is received within a cup 23 carried on the hub 22 and a plush fabric 25 having a pile directed back toward the bearings 12*a* and 12*b* so that this yarn package 27 may be slipped into the cup 23 but will not slide out.

The spindle 14 is provided with a flyer 32 in the form of a sleeve comprising a base disk 28 provided on its face turned away from the whorl 16 with a elastomeric insulating disk 30 on which is received a cup-shaped outer tube 36 in which is received a similarly cup-shaped inner tube 34. The base 40 of the outer tube 36 is cemented to the vibration-damping disk 30 and the base 38 of the inner tube 34 is cemented to a metal disk 48 which is in turn secured to the base 40. Provided between the tubes 34 and 36 is a corrugated sleeve 42 whose corrugations extend circumferentially and have inner crests 44 bonded to the inner tube 34 and outer valleys 46 bonded to the inside of the outer tube 36. The flyer 32 is extremely stiff and resistant to bending relative to the axis A due to this construction.

The inner and outer tubes or shells 34 and 36 are made of aluminum having a thickness of between 0.2 and 1.2 mm, preferably between 0.3 and 0.6 mm and here about 0.3 mm. The inner diameter of the tube 34 is between 150 and 420 mm, here about 200 mm, and the spacing between the two tubes 34 and 36 is between 5 and 15 mm, here about 8 mm. The corrugated spacer 42 is made of aluminum of the same thickness and is welded to both shells.

Figure 3:
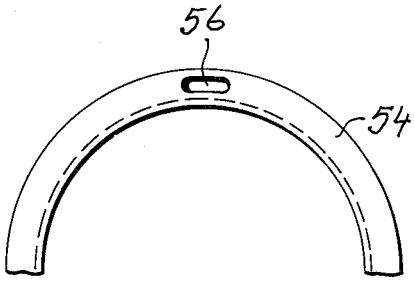
FIG. 3 is an end view of a detail of the apparatus as indicated by arrow III of FIG. 1.

A radial slot 50 formed in the spacing disk 48 opens at its inner end into an axial bore 60 formed in the end of spindle 14 and its other end into an axial passage 52 formed between the two tubes 34 and 36. A stiffening ring 54 engaged over the end of the inner tube 34, which is substantially axially shorter than the outer tube 36, is formed with a hole 56 (See FIG. 3) which constitutes the other end of the passage. The ring 54 is cut away at 57 to counterbalance the hole 56. The region 58 of the outer tube 36 beyond the inner tube 34 is highly polished and has a rolled edge 59 so that the filament 68 which will lie helically on it cannot snag on it. This filament 68 is drawn off the yarn packet 27 and passes axially through a guide tube 64 mounted on the support 22 and provided with a thread brake 62 as described in the commonly assigned patent application Ser. No. 188,335 filed Oct. 12, 1971 and now U.S. Pat. No. 3742693. Thereafter it enters the passage 60, 50, 52 and issues from the apparatus through a fixed eye 70 in line with the axis A.

The whorl 16, and hence the spindle 14, is rotated at high speed by the belt 18 so that a high degree of twist is imparted to the filament 68. The support 22 and yarn package 27 are prevented from rotating themselves by an eccentric weight 66 which is secured to the base of the support 20 and which has a center of gravity 67 normally lying below the axis A. This offset weight 66 overcomes any entrainment of the support 22 through the bearing 20 or by air currents in the device. The mouth 63 of inlet tube 64 is located within the yarn package 27 at a position spaced by a distance *d* from the bottom of the package, measured in the direction of axis A. The package has a height D which is equal to slightly more than twice the distance *d* for minimum straining of the yarn 68 being pulled off the inside of the package 27.

The entire assembly described above is received in a light metal (aluminum) can 72 which is fixed on the support 10 and prevents the whirling spinners from generating currents of air that might cause problems in working with a whole bank of such devices. Heaters 73 are provided on the inside walls of the can to heat the filament 68, and a heat shield is provided between the flyer assembly 32 and the bearings 12*a* and 12*b* to protect these bearings.

The distance between the eye 56 and the eye 70 is the only region in the present device where the thread is subjected to any significant air resistance, since otherwise it is enclosed in the passage 60, 50, 52 in the flyer 32. This distance is very short so that chances of breakage are sharply reduced, and a very light thread tension can be employed. This is of particular interest with extremely weak glass yarns.

Figure 2:
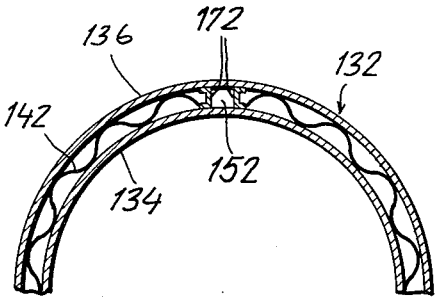
FIG. 2 is a fragmentary section through an alternative form of a detail of the present invention corresponding to line II—II of FIG. 1.

FIG. 2 shows a flyer 132 whose two tubes 134 and 136 are separated by a corrugated element 142 whose corrugations run parallel to the axis of the device. A pair of axially extending U-section bars 172 are provided between the ends of the longitudinally corrugated separator 142 to define a passage 152.

Figure 4:
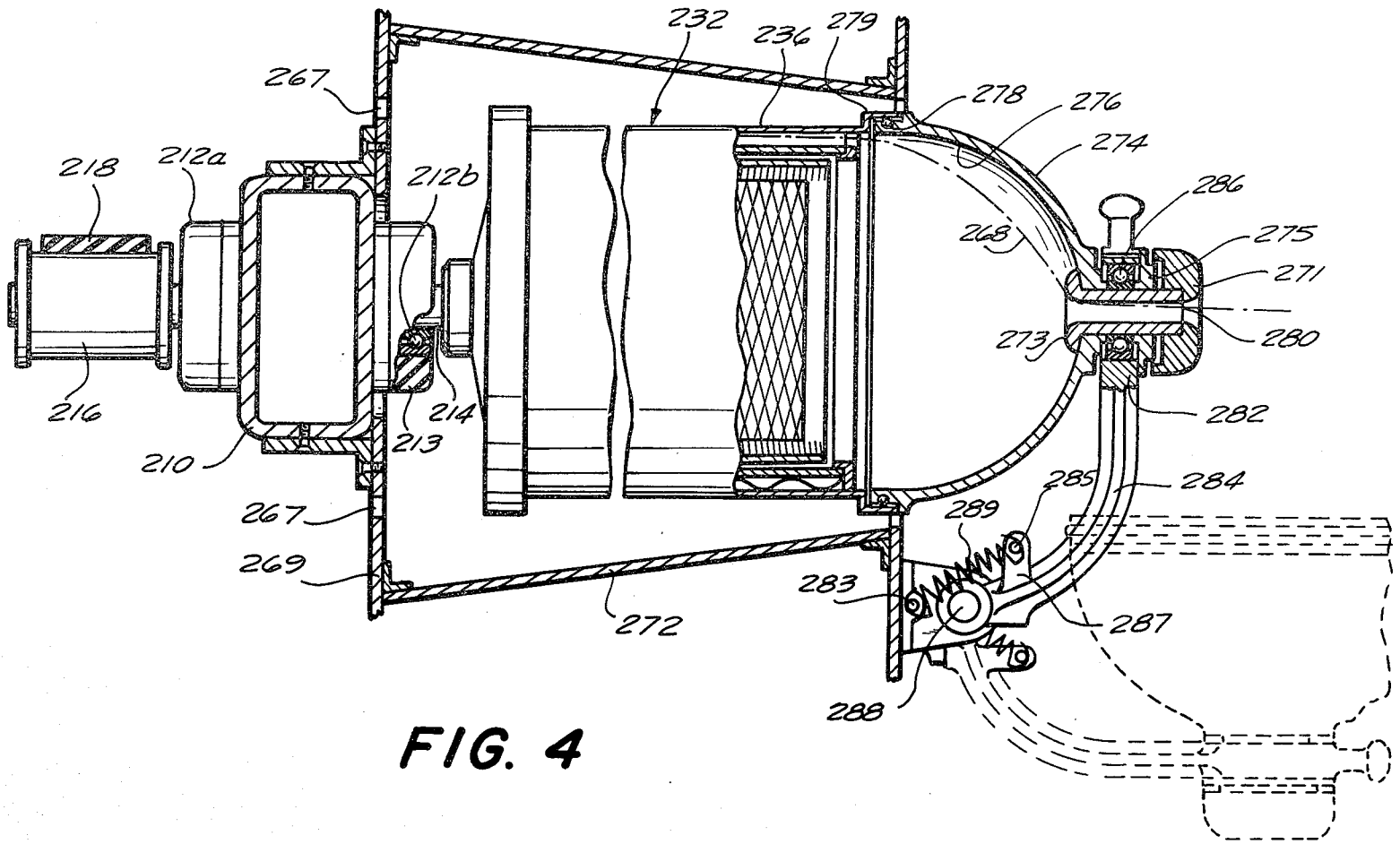
FIG. 4 is an axial section through another embodiment of the present invention.

The apparatus of FIG. 4 has a spindle 214 mounted on a pair of bearings 212*a* and 212*b* carried on a support beam 210 and is provided on one end with a whorl 216 driven by a flat belt 218 and on its other end with a flyer 232 similar to the flyer 32 of FIG. 1.

This flyer 232 has an outer tube 236 which is stepped outwardly at 279 and receives the rim 276 of a bell 274. An O-ring 278 makes the fit between the rim 276 and step 279 snug. This bell 274 is basically hemispherical and constitutes a cover for the flyer 232 which rotates with this cover 274. It is formed with a neck 275 supported in a bearing 286 in an eye 282 in the end of an arm 284. This arm is pivoted on the fixed shield 272 at 288 and is formed with a lug 287 provided with a pin 285 connected to a pin 283 on the support 272 by means of a tension spring 289. The pins 283 and 285 do not lie in a line with the pivot 288 in either the solid-line closed position of the cover 274 or in the dot-dash open position thereof. Thus this spring 289 acts as a toggle to maintain the cover in either of these positions.

The neck 275 is provided with a pair of interfitted elements 271 and 273 that define an axial hole 280 through the cover 274. The sleeve element 273 and the ring element 271 fitted thereon are very smooth inside to prevent the filament 268 from snagging and breaking.

This arrangement relieves the bearings 212*a* and 212*b* of the stresses caused by the horizontal position of the flyer 232. The bearing 212*b* is cushioned by rubber ring 213. In addition the thread 268 is enclosed for all of the distance where it is not running perfectly axially, to that air resistance is again reduced and a very light thread tension may be employed. The housing 272 is frustoconical and wider near the base 269 which is perforated at 267 for cooling of bearings 212*a* and 212*b*, shown seated in rubber washers 213.

FIG. 5 shows a whorl brake usable with the embodiment of FIG. 2. The belt 218 runs over two idler wheels 217 to each side of the whorl 216 and the belt as shown in FIG. 6 normally engages this whorl 216 tangentially to drive it.

A pair of scissor arms 290*a* and 290*b* are pivoted on the beam 210 at the horizontal pivot 211. These arms carry respective fiber pads 292*a* and 292*b* which engage the whorl 216 when they are closed thereon (FIG. 5) and with rollers 294*a* and 294*b* which push the belt 218 of the tape drive away from this whorl in this closed position. Instead of the rollers 294*a* and 294*b* each arm can be provided with a bumper as shown at 296*a* in FIG. 5*a*. Such a bumper is made of polytetrafluoroethylene or some similar material with a very low coefficient of friction.

The other ends of the arms 290*a* and 290*b* are connected together by a bowden arrangement with the core cable 298 attached to the arm 290*b* and the sheath 300 connected to the arm 290*a*. A compression spring 302 urges these two ends apart and, therefore, biases the brake into the open or ineffective position shown at FIG. 6.

The other end of the bowden cable is connected between a pedal 304 pivoted on the floor at 306 and a support 310. A compression spring 308 of relatively weak force is provided to keep the system tight, and another stiffer spring 312 is braced between the fixed support 310 and the end 299 of the cable 298. This latter spring 312 insures that both arms 290*a* and 290*b* move rather than just one of them. Depression of the pedal 304 displaces the sleeve 300 relative to the cable to compress the spring 302 thereby bringing the ends of the arms 290*a* and 290*b* together. This pushes the pads 292*a* and 292*b* against the whorl 216 and pushes the belt 218 out of contact with this whorl so that the belt rides on the rollers 294*a* and 294*b* instead. This arrangement is used when a yarn package must be changed or when the filament breaks and must be rethreaded.

In FIG. 7 a substantially similar device is shown with two arms 490*a* and 490*b* whose ends are connected by a pair of rigid links 491*a* 491*b* pivoted together at 495. A tension spring 496 between the pivot 411 of the arms 490*a* and 490*b* biases the arms apart. A solenoid 493 operable by a switch 497 connected to line is itself connected to the pivot 495 such that on energization it pulls the pivot 495 away from the pivot 411 and closes the jaws 492*a* and 492*b* on the whorl 216.

Figure 8:
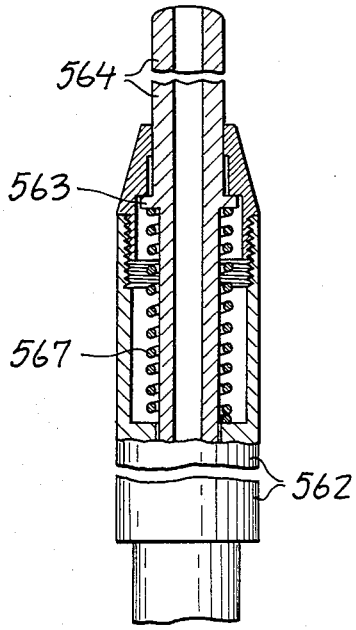
FIG. 8 is a side partly sectional view of a feed tube according to this invention.

FIG. 8 shows a guide tube 564 which can be used in place of the guide tube 64 of FIG. 1. This tube 564 telescopes in the housing 562 for the thread brake. A compression spring 567 is compressed between the element 562 and a shoulder 563 on the tube 564 so that as the thread tension momentarily increases, due to excess size in the yarn or a like condition, this tube 564 can move inwardly to compensate for the momentary difference, thereby avoiding annoying breakages in the filament.

Figure 9:
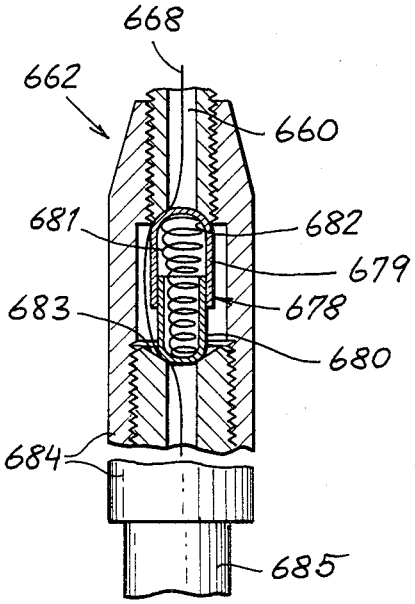
FIG. 9 is a view similar to FIG. 8 of another feed tube structure.

The thread brake 662 is shown in FIG. 9. It comprises an extensible lozenge or capsule 678 formed of two telescoping shells 679 and 680 between which a spring 681 is compressed. This lozenge 678 fits between two frustoconical seats 682 and 683 formed in the passage 660. Thus the filament 668 is pinches above and below the lozenge 678 and the braking effect is adjusted by screwing the outer sleeve 684 housing the brake 662 down onto the hollow rod 685 which is attached to the yarn-package support.

I claim:

1. A yarn-spinning apparatus especially for low tensile strength multithread yarn comprising:

a spindle lying along and rotatable about an axis;

a flyer having a base attached to said spindle and a sleeve extending axially from said base, said spindle and said flyer being formed with a passage opening axially at one end away from said base at said axis and opening axially at the other end away from said base at a location offset from said axis on said sleeve;

a yarn holder carried on and rotatable relative to said spindle and including an axially open cup snugly receiving an annular coreless yarn package and a tube lying along said axis in line with said one end of said passage and having a mouth opening away from said base and lying within said package;

means for preventing said holder from rotating about said axis;

a thread brake in said tube;

a bell cover engageable with the end of said sleeve remote from said base and formed with a hole lying on said axis and a neck surounding said hole;

a frame supporting said spindle;

an arm pivotal on said frame; and bearing means on said arm surrounding said neck for rotation of said cover with said sleeve about said axis.

2. The apparatus defined in claim 1, further comprising a frame supporting said spindle, and a housing surrounding said sleeve and opening axially away from said base.

3. The apparatus defined in claim 1, further comprising a frame and at least one elastically mounted bearing between said frame and said spindle.

4. A yarn-spinning apparatus especially for low tensile strength multithread yarn comprising:

a spindle lying along a rotatable about an axis;

a flyer having a base attached to said spindle and a sleeve extending axially from said base, said spindle and said flyer being formed with a passage opening axially at one end away from said base at said axis and opening axially at the other end away from said base at a location offset from said axis on said sleeve;

a yarn holder carried on and rotatable relative to said spindle and including an axially open cup snugly receiving an annular coreless yarn package and a tube lying along said axis in line with said one end of said passage and having a mouth opening away from said base and lying within said package;

means for preventing said holder from rotating about said axis;

a thread brake in said tube;

a whorl on said spindle;

means including a belt tangentially engaging said whorl for rotating said spindle;

a fixed support, said spindle being journaled in said support;

a pair of crossing elongated arms pivoted on said support adjacent said whorl at their crossover region, each of said arms having one end simultaneously engageable with said whorl and with said belt; and means connected to the other ends of said arms for pivoting said one end toward one another and thereby closing same on said whorl and pushing said belt out of contact with said whorl.

5. The apparatus defined in claim 4 wherein said means include a bowden cable having an outer sleeve connected to one of said other ends, and an inner cable connected to the other of said other ends.

6. The apparatus defined in claim 4 wherein each of said arms is provided at its said one end with a roller engageable with said belt.

7. The apparatus defined in claim 4 wherein said cup is provided with a soft lining engaging and holding said package.

8. The apparatus defined in claim 7 wherein said lining is a piled textile having a pile extending toward said base, whereby said package can be slipped into said cup in the direction of said pile but will resist displacement in the opposite direction.

9. The apparatus defined in claim 4 wherein said axis is generally horizontal, said means for preventing rotation of said holder being an eccentric.

10. The apparatus defined in claim 4, further comprising a fixed housing surrounding said flyer and said holder, and means in said housing for heating said filament as it passes through said passage.

11. The apparatus defined in claim 4 wherein said sleeve is formed of a pair of coaxial nested inner and outer tubes secured to said base and defining said passage.

12. The apparatus defined in claim 11 wherein said sleeve further comprises a corrugated stiffening element between said inner and outer tubes and fastened thereto.

13. The apparatus defined in claim 11 wherein said element has corrugations extending parallel to said axis.

14. The apparatus defined in claim 11 wherein said element has corrugations extending circumferentially of said axis.

15. The apparatus defined in claim 11, further comprising a centering ring between the end of said inner tube turned away from said base and said outer tube, said ring being formed with a hole in line with said passage and constituting a portion thereof.

16. The apparatus defined in claim 15 wherein said centering ring is formed as a balance equalizer with at least one cutout diametrically opposite said hole.

17. The apparatus defined in claim 11 wherein said inner and outer tubes and said stiffening element are comprised of sheet metal between 0.2 and 1.2 mm thick, said tubes being spaced radially apart by a distance between 5 and 15 mm.

18. The apparatus defined in claim 17 wherein said tubes and said stiffening element are welded together.

19. The apparatus defined in claim 17 wherein said inner and outer tubes and said stiffening element are cemented together.

20. The apparatus defined in claim 11 wherein said inner and outer tubes are each formed with a tube base connected to the base of said flyer, said passage extending between said tube bases, said flyer further comprising an elastomeric insulating disk between said tube bases.

21. The apparatus defined in claim 20 wherein said outer tube extends beyond said inner tube in a direction away from said base.

* * * * *